United States Patent [19]

Breslow

[11] Patent Number: 4,934,645

[45] Date of Patent: Jun. 19, 1990

[54] SHELVING ASSEMBLY

[75] Inventor: David S. Breslow, Chicago, Ill.

[73] Assignee: RTC Industries, Inc., Chicago, Ill.

[21] Appl. No.: 325,395

[22] Filed: Mar. 20, 1989

[51] Int. Cl.[5] ..... A47G 29/02

[52] U.S. Cl. ..... 248/242; 248/291; 108/108

[58] Field of Search ..... 248/291, 235, 240, 240.4, 248/397, 222.1, 241, 242, 243, 286; 108/108, 5; 211/151, 187, 175

[56] References Cited

U.S. PATENT DOCUMENTS

| | | | |
|---|---|---|---|
| 3,463,433 | 8/1969 | Stein | 248/242 |
| 3,550,891 | 12/1970 | Scott | 248/291 |
| 3,561,713 | 2/1971 | Berkowitz | 248/291 |
| 3,795,379 | 3/1974 | Gray | 248/242 |
| 4,620,489 | 11/1986 | Albano | 108/108 |

FOREIGN PATENT DOCUMENTS

| | | | |
|---|---|---|---|
| 674836 | 11/1963 | Canada | 248/242 |
| 693660 | 8/1965 | Italy | 248/242 |
| 6503140 | 9/1966 | Netherlands | 248/242 |
| 957329 | 5/1964 | United Kingdom | 248/242 |

*Primary Examiner*—Ramon O. Ramirez
*Assistant Examiner*—Robert A. Olson
*Attorney, Agent, or Firm*—Dressler, Goldsmith, Shore, Sutker & Milnamow, Ltd.

[57] ABSTRACT

A shelving assembly mountable on conventional vertical, slotted standards. The shelving assembly includes a shelf and brackets permitting movement of the shelf on the brackets between a rear merchandising position and a forward stocking position, and permitting movement into selected horizontal and inclined merchandising positions.

13 Claims, 3 Drawing Sheets

FIG. 1
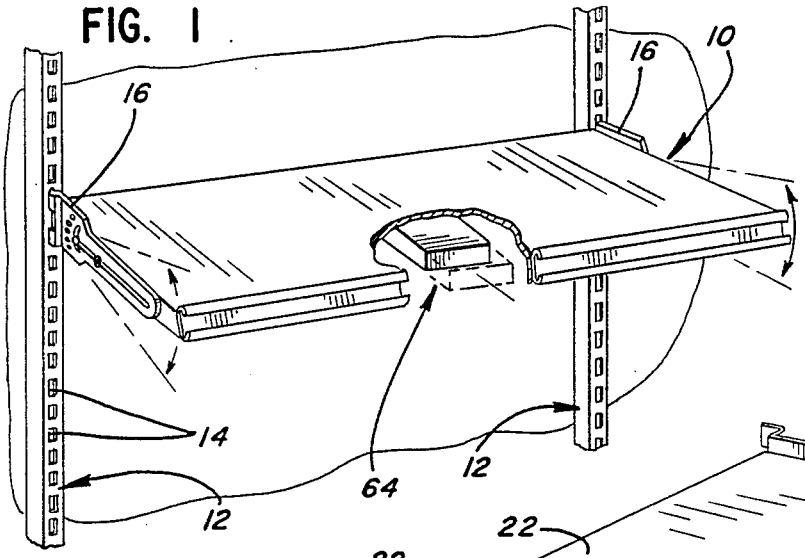
FIG. 3
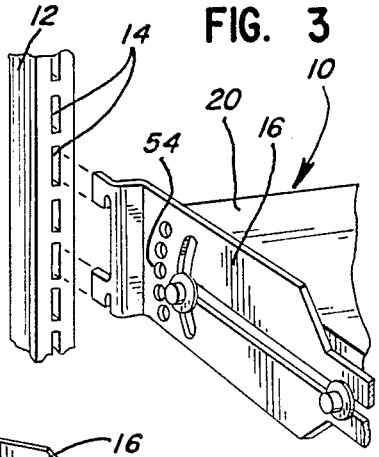
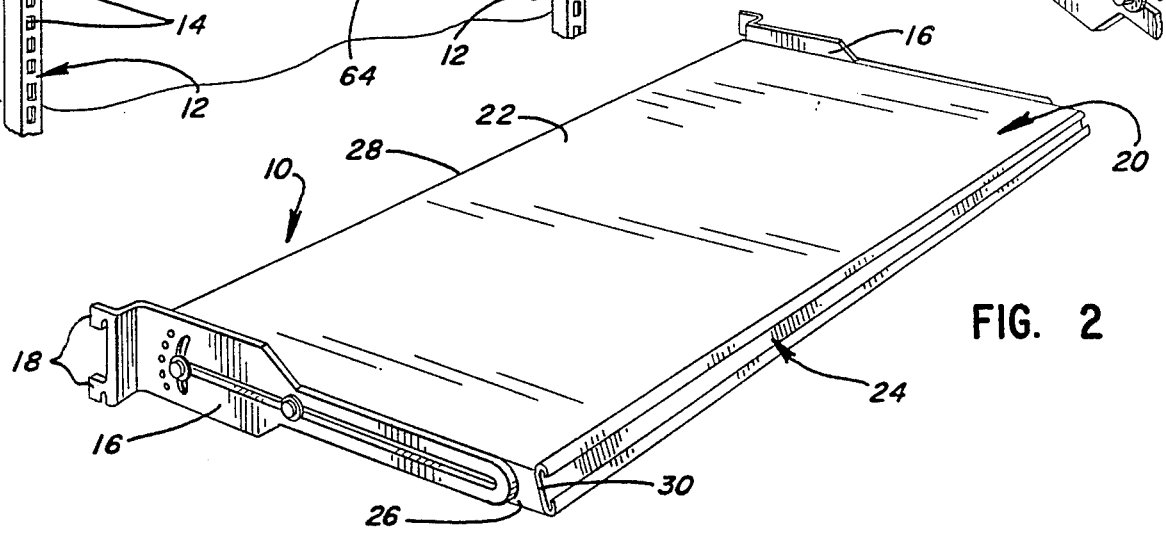
FIG. 2
FIG. 5
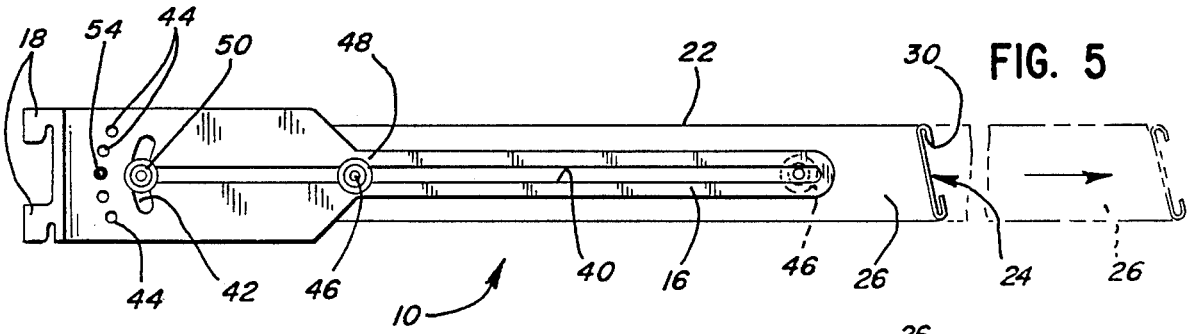
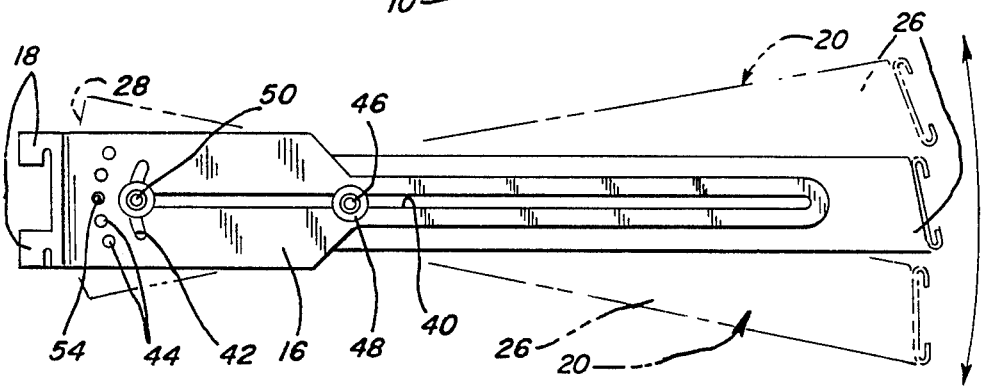
FIG. 4

FIG. 6
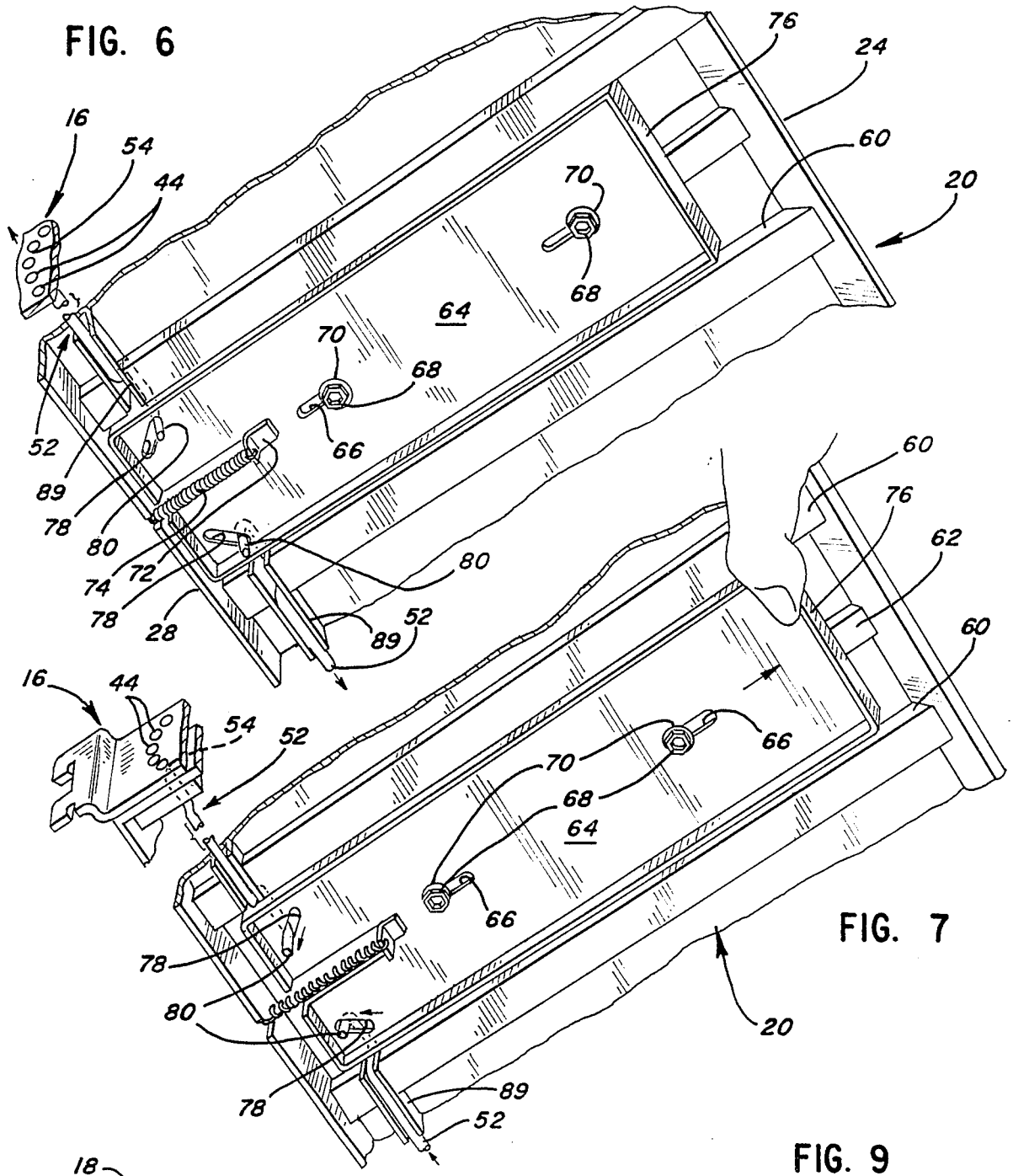
FIG. 7
FIG. 9
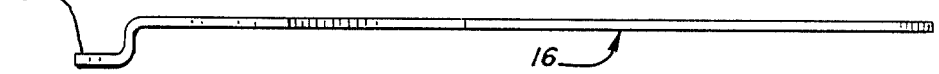
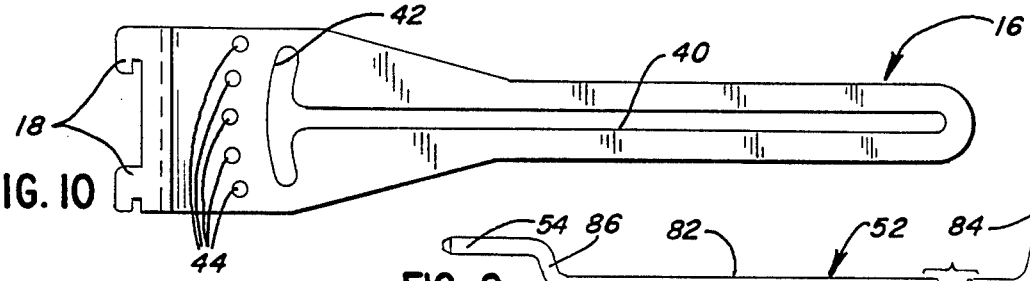
FIG. 10
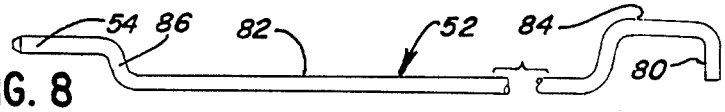
FIG. 8

SHELVING ASSEMBLY

BACKGROUND OF THE INVENTION

Various kinds of shelving supported from slotted vertical standards by cantilever support brackets are available and are used for domestic and commercial purposes.

There are environments in which shelving would desirably provide for movement of a shelf into a variety of angular orientations, i.e., to be displaced from a horizontal orientation to a forwardly or rearwardly inclined orientation.

Further there are environments in which it is desirable to move a shelf forwardly from its display position into a forward stocking position.

It would be desirable also to provide shelving which readily, conveniently and easily could make it possible both to move a shelf to and from between stocking and display positions and to allow the shelf, when desired, to be moved from a horizontal display position to a forwardly or rearwardly inclined display position.

SUMMARY OF THE INVENTION

In accordance with the present invention a shelving assembly is provided which is adapted to be removably mounted on, and to be suspended from, supports such as vertically disposed slotted standards and having an elongate shelf having an expansive upper merchandising surface, and back, side and front edges, and a bottom, together with a pair of elongated brackets, one at each side. The brackets are pivotally secured to the shelf at each side edge at a pivot point on the shelf intermediate the lengths of the brackets Each bracket has formations such as hooks at the rear end for engaging a slotted standard.

Positioning means are mounted at the side edges of the shelf and adjacent the rear ends of the brackets for engaging the bracket thereat for securing the shelf upper surface in predetermined horizontal and multiple inclined positions. Manually operable adjustment means are provided on the shelf for moving the positioning means out of engagement with the brackets to facilitate movement of the shelf upper surface among said predetermined horizontal and inclined positions, and for moving the positioning means into engagement with the brackets to secure the shelf upper surface in one of those predetermined positions.

Desirably the adjustment means comprises a handle means movably mounted on the bottom of the shelf for movement in opposite directions, and locator rods mounted on the bottom of the shelf, with one end of the locator rods being movable with the handle means and with the other end mounting said positioning means. The brackets may define multiple openings adjacent the rear end thereof. Each of the openings is substantially equidistant from the pivot point. The openings are adapted to receive the positioning means, thereby to selectively secure the shelf upper surface in one of the predetermined positions.

In a preferred form, the locator rods are secured to the handle means at one end of the locator rods, so that when the handle means is moved in one direction, the positioning means are moved out of engagement with the brackets and when the handle means are moved in the opposite direction, the positioning means are moved into engagement with the brackets. The handle means may define camming slots, and may be mounted for movement on the shelf in directions parallel to the side edges of the shelf, with one end of each locator rod engaging in a camming slot in the handle means.

In a preferred form cooperating means on the elongate shelf and the brackets permit the shelf, when the positioning means are out of engagement with the openings, to be slid forwardly between a forward stocking position and a rear merchandising position which maintains the shelf in a horizontal position.

The cooperating means may comprise a longitudinal slot in each bracket and a projection on each side of the shelf located near the rear edge of the shelf, and disposed in a longitudinal slot. The pivot points may comprise a pin on each side of the shelf, each pin being disposed in one of the longitudinal slots, with the projections and the pins providing two-point supports for the shelf in its forward stocking position. The brackets define an arcuate slot segment at the rearward end of the longitudinal slot, so that when the shelf is in a merchandising position and the positioning means is moved out of engagement with the openings, the slot segments, in cooperation with the projections, positively limits the range of movement of the shelf about the pivot points.

Further objects, features and advantages of the present invention will become apparent from the following drawings and specification.

BRIEF DESCRIPTION OF THE DRAWINGS

FIG. 1 is a front perspective view of a shelving assembly of the present invention, partially broken away, showing it mounted on slotted standards;

FIG. 2 is a top perspective view of a shelving assembly of FIG. 1;

FIG. 3 is an enlarged fragmentary view of a portion of FIG. 1;

FIG. 4 is a side elevational view of FIG. 2 showing the shelving assembly in multiple selected merchandising positions;

FIG. 5 is a side elevational view of FIG. 2 showing the shelving assembly in a display position, and, in dotted line, in a forward stocking position;

FIG. 6 is a bottom view of the shelving assembly of FIG. 2 with the locator rods in engagement with the brackets;

FIG. 7 is a bottom view like FIG. 6 but showing the locator rods in retracted positions and out of engagement with the brackets to permit movement of the shelf relative to the brackets; and FIG. 8 is a side elevational view of a locator rod;

FIG. 9 is a top view of the bracket of FIG. 2;

FIG. 10 is a side elevational view of the brackets of Fig 2; and

DESCRIPTION OF A PRESENTLY PREFERRED EMBODIMENT

Figure 11:
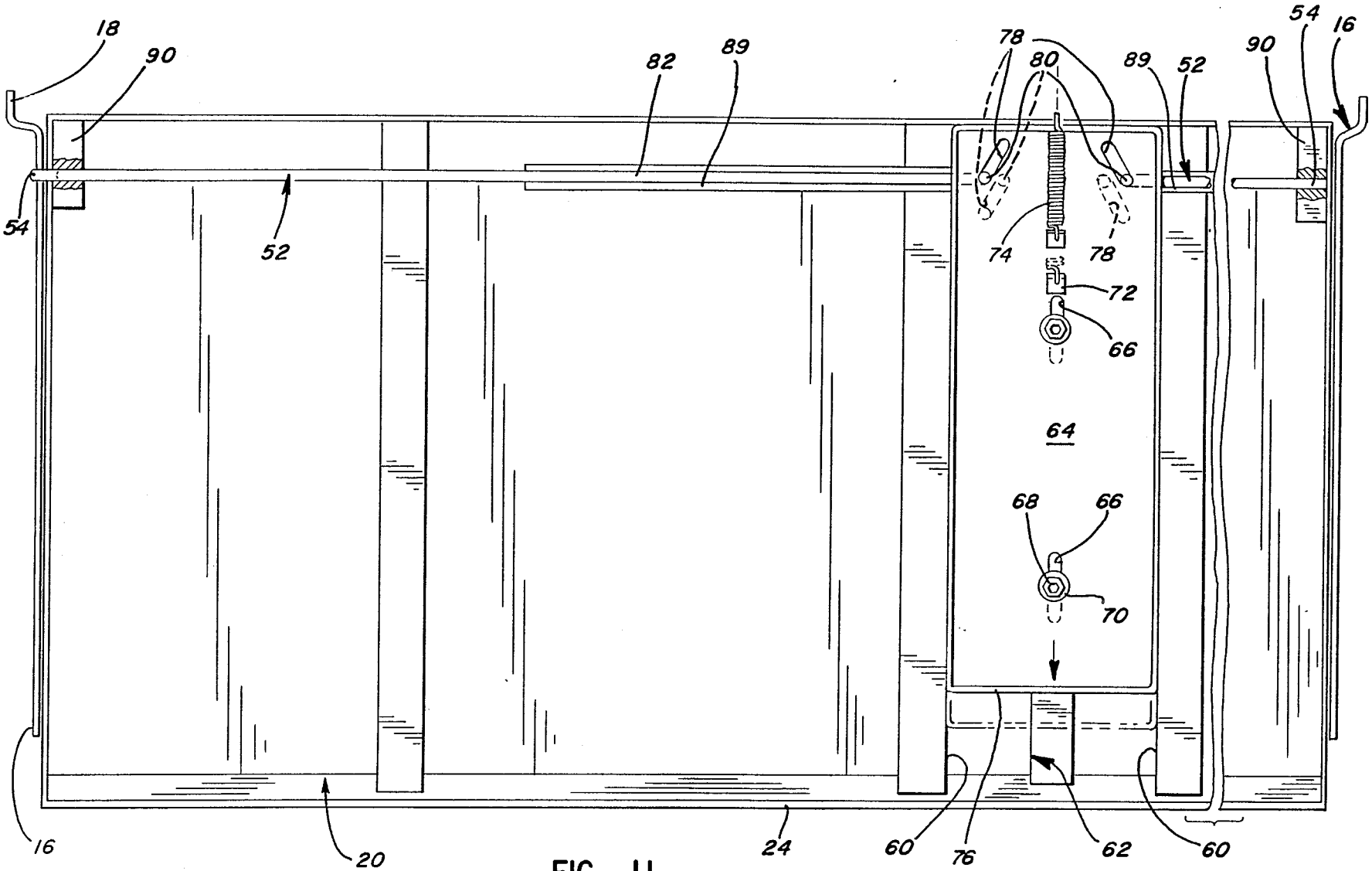
FIG. 11 is an overall bottom view, like FIGS. 6 and 7, showing additional detail.

Referring now to the drawings, and first to FIG. 1, a shelf assembly 10 is shown as being removably mounted on and suspended from supports such as conventional slotted standards 12 which are adapted to be wall mounted or otherwise supported in vertical positions. Standards 12 may typically comprise U-shaped metallic members which are provided with vertically spaced vertical slots 14. Suitable holes (not shown) through which screws may pass for securance of the standards to a wall may be provided, as is conventional practice.

Shelf assembly 10 includes a pair of elongated cantilever brackets 16, one at each side of the shelf, each of which is the mirror image of the other and which is identically mounted and attached, as will be described. Each bracket 16 defines at least one formation such as a hook formation or hook 18 (in this case two hooks) at the rear end of the bracket. The hooks 18 are proportioned to be accommodated within a pair of vertically adjacent slots 14. The hooks and rear of the bracket 16 are proportioned so that they snugly fit in the slots, with the back of the bracket bearing against the face of the standard 12 to provide as solid a bearing engagement as possible, all as is well-known and conventional in the art.

In accordance with the present invention, the shelf assembly comprises an elongate shelf 20. A typical shelf 20 may be about 3 feet wide and about 12 inches deep and fabricated of steel to provide a flat expansive upper merchandising surface 22, an inclined front or forward edge 24, side edges 26 and a back edge 28, and a bottom. The forward edge may be provided with trim to define a track 30 for price or other informational inserts. Of course, the materials used and the shapes and sizes of the shelf 20 may be varied, and alternatives will be readily apparent to those skilled in the art.

As best seen in FIGS. 4, 5 and 10, each of the brackets 16 defines a generally longitudinally disposed elongate slot 40 which terminates in an arcuate slot 42 near the rear end, the hook-end, of the bracket. Adjacent the rear end multiple circular openings 44 are provided. These openings lie along the circumference of a circle, the center of which is equidistant from the centers of the circular openings and which is at the pivot pin 46 when the shelf is in its rear merchandising position. The circumference of the openings 44 is also concentric to the arcuate slot 42.

Each bracket 16 is pivotally secured to the shelf 20 at a side edge 26 at a pivot point via a pivot pin 46 having an enlarged head 48 to prevent retraction of the pivot pin from the slots 40. Pivot pin 46 is fixedly secured to the shelf side edge 26 in a central region of the side edge and intermediate the length of the bracket.

An additional projection, such as a headed pin 50 is fixedly secured to the side edge 26 rearwardly of pin 46. Pin 50 is usually positioned at a location within arcuate slot 42. The head of pin 50 is sized so that pin 50 will remain within slot 42. Pins 50, when within the arcuate slots, positively limits the range of movement of the shelf about the pivot point provided by pivot pin 46. Although pins 46 and 50 may be headed pins, they may also be, as illustrated, pins with outer enlarged restraining washers held in place by split spring washers.

As will be best seen from FIGS. 4 and 5, the pins 46 and 50 permit several types of movement of the shelf 20 relative to the brackets 16. Thus, when the elongate slot 40 is horizontal as shown in full line in FIGS. 4 and 5, the shelf may be slid forwardly from the full line position, to the dotted line position of FIG. 4, namely from a rear horizontal merchandising or display position to a forward stocking position, and may be slid rearwardly to the rear merchandising position again. In that mode of operation the projection or pin 50 and pin 46 on each side provide a two-point support for the shelf in its forward stocking position.

The shelf 20 is normally locked into a rear merchandizing position. To that end a pair of locator rods 52 are provided and are mounted on the bottom of the shelf. Each has an outer end 54, which may preferably be chamfered, and which is proportioned to be snugly received within a circular opening 44 to lock and hold the shelf in a predetermined orientation or position defined by the location of the particular, selected opening 44. Thus, in the embodiment illustrated, the shelf may be held in a horizontal position and in four possible selectable inclined positions, two of which are forwardly inclined and two of which are rearwardly inclined, as best seen in FIG. 5.

The outer ends 54 of the locator rods 52 are adapted to be retracted from and to be reengaged within the circular openings 44 in a manner which will now be described, with special reference to FIGS. 6, 7 and 11 which show the bottom of the shelf 20 and the mechanism for operating the locator rods. The outer ends 54, as will be apparent, serve to position the shelf and brackets in the predetermined horizontal and inclined positions.

The shelf bottom, adjacent its central zone, defines a pair of guide ribs 60 which extend from the forward edge 24 to the back edge 28. Between them a rib 62 is provided. A manually operable adjustment means or handle 64 which is nested between ribs 60 is provided. Handle 64 defines a pair of elongated slots 66 overlying rib 62 A pair of screws 68 with associated washers 70 depend through the respective slots 66 and mount the handle for reciprocating, sliding movement of the handle on the bottom of the shelf within the limits of the length of the slots 66. Handle 64 also is provided with a mounting tab 72 to which one end of a coiled tension spring 74 is secured. The other end of the spring is connected at back edge of the shelf. Thus the handle 64 is biased to a rearward position (FIGS. 6 and 11), but is readily movable forwardly (in the opposite direction) against the action of the rearward bias of the spring 74 via a pull 76 at the forward edge of the handle.

The rear of the handle (adjacent the back edge 28 of the shelf) defines a pair of angled camming slots 78. These slots angle rearwardly and towards each other. Each camming slot 78 slidably receives the inner end 80 of a locator rod 52.

Locator rods further define a central portion 82. The central portion 82 terminates inwardly in a generally U-shaped portion 84 including inner end 80 and outwardly in an angled segment 86. The outer end 54 and central portion 82 are generally parallel. The thusly offset central portion is preferably positioned within a guide 89 of plastic or metal on the shelf bottom to maintain the vertical positioning of the inner end 80 of the locator rod and for slidably guiding the locator rod as it moves in the manner to be described. Bearings or guides 90 at the sides of the shelf are provided to guide the outer ends 54 relative to the brackets 16 and openings 44 therein.

As such, when the handle 64 is moved forwardly, the angled slots 78 draw the movably associated inner ends 80 inwardly, moving the entire locator rods 52 inwardly, of course also moving the outer ends 54 inwardly towards the shelf 20, thereby withdrawing the outer ends 54 out of engagement with the brackets and associated circular openings 44 and freeing the brackets from their locked or interconnected engagement with the shelf via rods 52. Desirably, the side edges of the shelf may be provided with slide guides for the outer ends of the rods 52.

When the brackets are so freed, the shelf may be slid forwardly, if pin 50 is aligned with elongate slot 40, to a forward stocking position. Also, when the brackets are so freed, the shelf 20 and its upper surface may be oscillated about pivot pins 46 to align the outer ends 54 of the locator rods 5 with selected ones of the circular openings 44. If after retraction and initial pivoting of the shelf to a selected horizontal or inclined position the handle 64 is released and freed to move in the rearward or opposite direction, so that when the chamfered ends 54 engage the side edges of an opening 44, the ends will be biased outwardly via spring 74, and will then move home into engagement with the brackets to lock and secure shelf upper surface and brackets in a selected relationship for display or merchandizing purposes.

It will be apparent to those skilled in the art that modifications may be made in the specific embodiment described and illustrated without departing from the spirit and scope of the invention and the appended claims.

What is claimed is:

1. A shelving assembly adapted to be removably mounted on and to be suspended from supports comprising, an elongate shelf having an expansive upper merchandising surface, and having back, side and front edges, and a bottom, a pair of elongated brackets, one at each side, said brackets being pivotally secured to the shelf at each side edge at a pivot point on the shelf intermediate the length of the bracket, and each bracket having formations at the rear end for engaging a support, positioning means mounted at the side edges of the shelf and adjacent the rear ends of the brackets for engaging the bracket thereat for securing the shelf upper surface in predetermined horizontal and multiple inclined positions, and manually operable adjustment means in a direction substantially normal to the shelf side edges on said shelf for moving said positioning means out of engagement with said brackets to facilitate movement of said shelf upper surface among said predetermined horizontal and inclined positions, and for moving said positioning means into engagement with said brackets to secure said shelf upper surface in one of said predetermined positions.

2. The shelving assembly of claim 1, and wherein said adjustment means comprises a handle means movably mounted on the bottom of said shelf for movement in opposite directions, and locator rods mounted on the bottom of the shelf, one end of said locator rods being movable with said handle means and the other end mounting said positioning means.

3. The shelving assembly of claim 2, and wherein said brackets define multiple openings adjacent the rear end thereof, each of said openings being substantially equidistant from the pivot point, said openings being adapted to receive the positioning means, thereby to selectively secure said shelf upper surface in one of said predetermined positions.

4. The shelving assembly of claim 2, and wherein said locator rods are secured to said handle means at one end of said locator rods, and whereby when the handle means is moved in one direction, said positioning means are moved out of engagement with the brackets and when the handle means is moved in the opposite direction, the positioning means are moved into engagement with the brackets.

5. The shelving assembly of claim 4, and wherein the handle means defines camming slots, and is mounted for movement on said shelf in directions parallel to the side edges of the shelf, and wherein said one end of each of said locator rods engages in a camming slot in said handle means.

6. The shelving assembly of claim 2, and wherein said brackets define multiple openings adjacent their rear ends for receiving said positioning means.

7. The shelving assembly of claim 6, and further including cooperating means on said elongate shelf and said brackets for permitting said shelf, when said positioning means are out of engagement with said openings, to be slid forwardly between a forward stocking position and a rear merchandising position which maintains said shelf in said horizontal position.

8. The shelving assembly of claim 7, and wherein said cooperating means comprise a longitudinal slot in each said bracket and a projection on each side of said shelf located near the rear edge of said shelf, and disposed in a said slot.

9. The shelf assembly of claim 8, and wherein said pivot points comprise a pin on each side of said shelf, each said pin being disposed in one of said slots, said projections and said pins providing two-point supports for said shelf in its forward stocking position.

10. The shelf assembly of claim 8, and wherein each said bracket defines an arcuate slot segment at the rearward end of said longitudinal slot, whereby when said shelf is in a merchandising position and said positioning means is moved out of engagement with said openings, the slot segments, in cooperation with the projections positively limits the range of movement of the shelf about said pivot point.

11. A shelving assembly adapted to be removably mounted on, and to be suspended from, supports comprising, an elongated shelf having an expansive upper merchandising surface, and back, side and front edges, and a bottom, a pair of elongate brackets, one at each side edge, secured to the shelf, said brackets having formations for engaging supports at the rear of the brackets, pivot means spaced from the rear of the brackets pivotally securing said brackets to said shelf, whereby said shelf may pivot thereat between a horizontal and selectable inclined upper surface merchandising positions, and releasable adjustment means on said shelf and said brackets adjacent one end of the brackets for locking said shelf means in a selected merchandising position, comprising a plurality of openings in the rear ends of the brackets and engaging means mounted on said shelf which are movable substantially normal to the shelf side edges into and out of engagement with selected ones of said openings.

12. A shelving assembly in accordance with claim 11 and further comprising manually operable movable handle means mounted on said shelf and secured to said engaging means for moving said engaging means into and out of engagement with selected ones of said openings.

13. A shelving assembly in accordance with claim 11, and wherein said brackets define longitudinal slots and said shelf mounts a projection disposed in said slot, whereby said shelf may be moved forwardly relative to the brackets from the selected merchandising position to a forward horizontal stocking position, and wherein said projection and pivot means are spaced apart to cooperate in supporting said shelf in said forward horizontal stocking position.

* * * * *